US006165105A

United States Patent [19]

Boutellier et al.

[11] Patent Number: 6,165,105

[45] Date of Patent: Dec. 26, 2000

[54] APPARATUS AND METHOD FOR TRAINING OF THE RESPIRATORY MUSCLES

[76] Inventors: Urs Boutellier, Rychenbergstrasse 49A, Ch-8400 Winterthur, Switzerland; Clas E. G. Lundgren, 42 Burroughs Dr., Snyder, N.Y. 14226; Dan E. Warkander, 21 Wendel Ave., Buffalo, N.Y. 14223

[21] Appl. No.: 08/721,436

[22] Filed: Sep. 27, 1996

[51] Int. Cl.[7] ..... A63B 23/18

[52] U.S. Cl. ..... 482/13; 482/8; 600/531; 600/532; 600/541; 128/204.22; 128/914

[58] Field of Search ..... 482/1, 8, 13; 600/531, 600/532, 538–541, 529; 128/200.24, 204.22, 205.13, 205.14, 205.17, 207.16, 914

[56] References Cited

U.S. PATENT DOCUMENTS

| | | | |
|---|---|---|---|
| 3,923,043 | 12/1975 | Yanda | 600/541 |
| 4,192,301 | 3/1980 | Hardwick | 128/205.17 |
| 4,301,810 | 11/1981 | Belman . | |
| 4,441,506 | 4/1984 | McCombs . | |
| 4,854,574 | 8/1989 | Larson et al. . | |
| 4,981,295 | 1/1991 | Belman et al. . | |
| 5,154,167 | 10/1992 | Hepburn . | |

OTHER PUBLICATIONS

Howard, Robert P, et al. "Computerized Cardiopulmonary Stress Testing in Children" IEEE Trans. 648–651, 1979.

Flight Surgeon's Guide, Dec. 27, 1968, Dept. of the Air Force, Air Force Pamphlet No. 161–18.

Leith and Bradley, "Ventilatory muscle strength and endurance training," J. of Applied Physiology,41:508–516, 1976.

Boutellier and Piwko, "The respiratory system as an exercise limiting factor in normal sedentary subjects," Eur. J. of Applied Physiology, 64: 145–152, 1992.

*Primary Examiner*—John Mulcahy

*Attorney, Agent, or Firm*—Hodgson Russ Andrews Woods & Goodyear LLP

[57] ABSTRACT

Apparatus for exercising the muscles of the respiratory system for improving endurance. The apparatus includes a bag which is inflatable for receiving a predetermined volume of expired air. A valve is closed during rebreathing of expired air in the bag and is adapted to open in response to deflation of the bag to admit fresh air to the air way. The valve is also adapted to open when the bag is fully inflated to release excess expired air. The breathing frequency is paced so that, in combination with the predetermined volume, the overall ventilation may be maintained over a period of time for increasing endurance. As endurance is increased over time, the bag may be replaced with incrementally larger volume bags or the bag volume may be incrementally increased. Guidance of the training schedule and central monitoring of the training are also provided.

27 Claims, 8 Drawing Sheets

APPARATUS AND METHOD FOR TRAINING OF THE RESPIRATORY MUSCLES

The present invention relates generally to exercise apparatus. More particularly, the present invention relates to the exercising or training of the respiratory muscles.

Recent research has demonstrated that systematic training of the respiratory muscles can substantially increase a person's ability to sustain high levels of lung ventilation and, more importantly, may enhance a person's endurance when performing sub-maximal exercise. See U. Boutellier and P. Piwko, "The Respiratory System as an Exercise Limiting Factor in Normal Sedentary Subjects," Eur. J. Appl. Physiol. 64: 145–152, 1992.

U.S. Pat. Nos. 4,854,574 and 4,981,295 propose respiratory training devices which impose increased breathing resistance for strength training of the respiratory muscles. However, the experimental findings reported in D. Leith and M. Bradley, "Ventilatory Muscle Strength and Endurance Training," J. Appl. Physiol. 41: 508–516, 1976, indicate that maximal voluntary ventilation is not enhanced by respiratory muscle strength training but rather by respiratory muscle endurance training. Accordingly, it is our understanding that the flow resistance of the Boutellier and Piwko breathing device was kept as low as possible by keeping the diameters of the airway tubing large.

The Leith and Bradley article was not directed to the question of changes in whole body exercise endurance as a result of respiratory muscle training. This article indicates that the exercise capacity of fit individuals is generally not thought to be limited by ventilatory muscle endurance.

Using a breathing device (described hereinafter) for training respiratory muscle endurance, the Boutellier and Piwko article discusses testing wherein volunteers were subjected to respiratory muscle training (RMT) for 30 minutes per day for four weeks. During the RMT, the subjects in Boutellier's and Piwko's study breathed with breaths that were set at about 60% of the individuals vital capacity and the breathing frequencies were, at the beginning of the training period, about 38 breaths per minute. The tidal volumes were recorded by a pneumotachograph and a display of light signals on an array of light emitting diodes. The subjects watched the display and controlled the depth of each breath so that it matched upper and lower limits for inspiration and expiration which were also displayed as light signals. The desired breathing frequency was set on a metronome to which the subject had to adjust his/her breathing frequency. Each week the frequency was increased by one breath per minute. It was also understood that, alternatively, incremental changes in breath volume can be used. In order to counteract the effects of hyperventilation such as dizziness, which is due to excessive carbon dioxide elimination (hypocapnia), carbon dioxide was added to the inhaled air. By means of gas-analyzing equipment and a control valve, a physiologically acceptable carbon dioxide level was maintained in the lung air.

The effect of the RMT described above was recorded by measuring the subjects' respiratory endurance at a ventilatory level that, before training, was sustainable only for about 4 minutes. After the training, the subjects were able to perform the same level of ventilation for, on the average, 15 minutes. Furthermore, the subjects' endurance time when performing exercise on a cycle ergometer at an intensity corresponding to 64% of their respective maximal oxygen-uptake levels was tested before and after RMT. Before the RMT, the endurance time was typically 27 minutes in sedentary subjects, and, after RMT, it was increased by, on the average, between about 24% and 50%. Similar effects of RMT have also been observed in athletes, ranging in proficiency from the amateur to the professional level. See U. Boutellier, R. Buchel, A. Kundert, and C. Spengler, "The Respiratory System as an Exercise Limiting Factor in Normal Trained Subjects," Eur. J. Appl. Physiol. 65: 347–353, 1992. These observations indicate that respiratory muscle fatigue is performance limiting in healthy individuals performing sub-maximal exercise. It has furthermore recently been noted by others that the gains in sub-maximal exercise endurance obtained by RMT apply also to other types of physical activity than cycling, such as running, cross-country skiing, and rowing.

The Leith and Bradley article discloses a partial rebreathing system wherein subjects rebreathe on a large dead space tube using mouthpieces. At the mouthpiece, fresh gas is admitted from a rotameter and needle valve. A triple-J valve is attached distally of the dead space tube. A 7-liter bag on the J-valve's inlet serves as a reservoir and ventilatory target, i.e., air is admitted to it from a large rotameter, and subjects are required to keep it nearly empty. The two rotameters are set to presumably keep end-expired oxygen and carbon dioxide levels near normal values. Actual total ventilation is calculated as the target flow plus half the fresh gas flow since, during expiration, the latter half of the fresh gas flow is "thrown away" through an outlet from the J-valve. This apparatus undesirably requires a fan or compressed air source for admitting air to the bag and requires calibration of the large rotameter for setting the breathing target.

Furthermore, dead space can cause dangerous oxygen lack (hypoxia) and carbon dioxide accumulation (hypercapnia). The collector bag described in U.S. Pat. No. 5,154,167 may also cause hypoxia and hypercapnia if the bag volume selected is too large relative to the size of the user's breath. The incorporation of equipment for monitoring the composition of breathing gas is suggested in U.S. Pat. Nos. 4,301,810 and 5,154,167. However, this equipment typically is costly, bulky, and requires frequent calibration to be reliable.

U.S. Pat. No. 5,154,167 discloses a lung and chest exerciser wherein some of the air expired from the lungs is collected in a collector bag to be breathed back into the lungs on the next inbreath together with some fresh air through what is called a valve which consists of filter material held in place by a washer which fits behind lugs. It is further stated that, with a double thickness of filter material, the air resistance is such that on an inbreath all the air in the collector bag is breathed in before air is drawn through the filter. It is further disclosed that a slider may be used on the collector bag to alter the useable volume quickly and that a counting mechanism could be fitted to count the number of breaths.

An oxygen mask having a rebreather bag and an oxygen supply is disclosed in "Flight Surgeon's Guide," Air Force Pamphlet AFP 161-18, Department of the Air Force, Dec. 27, 1968. This oxygen mask is similarly equipped with sponge-rubber discs, which are said to serve as valves, through which the latter portion of the exhaled air is blown off. They are also said to serve as inspiratory ports for the entrance of ambient air when inspiration is not fully satisfied by the contents of the rebreather bag and the flow of oxygen from the regulator.

None of the above references discloses a practical apparatus for training for increasing endurance, which requires breathing speed as well as volume to be maintained over a period of time.

It is accordingly an object of the present invention to provide reliable, practical, and inexpensive respiratory muscle training apparatus for increasing endurance.

It is a further object of the present invention to provide such apparatus which does not expose the exerciser or trainee to physiologically unacceptable hypoxia and/or hypercapnia or hypocapnia.

In order to achieve the above objects, in accordance with the present invention an exerciser (a person training his or her respiration muscles) inspires from and expires to a bag which is inflatable for receiving a predetermined volume of expired air. A valve is provided to open in response to deflation of the bag to admit fresh air to the air way. The valve is closed during the flow of expired air into the bag. The breathing frequency is paced so that, in combination with the predetermined volume, the overall ventilation may be maintained over a period of time for increasing endurance. As endurance is increased over time, the bag may be replaced with incrementally larger volume bags or the bag volume may be incrementally increased.

The above and other objects, features, and advantages of the present invention will be apparent in the following detailed description of the preferred embodiments thereof when read in conjunction with the accompanying drawings wherein like reference numerals denote the same or similar parts throughout the several views.

DETAILED DESCRIPTION OF THE PREFERRED EMBODIMENT

Figures 1, 1B:
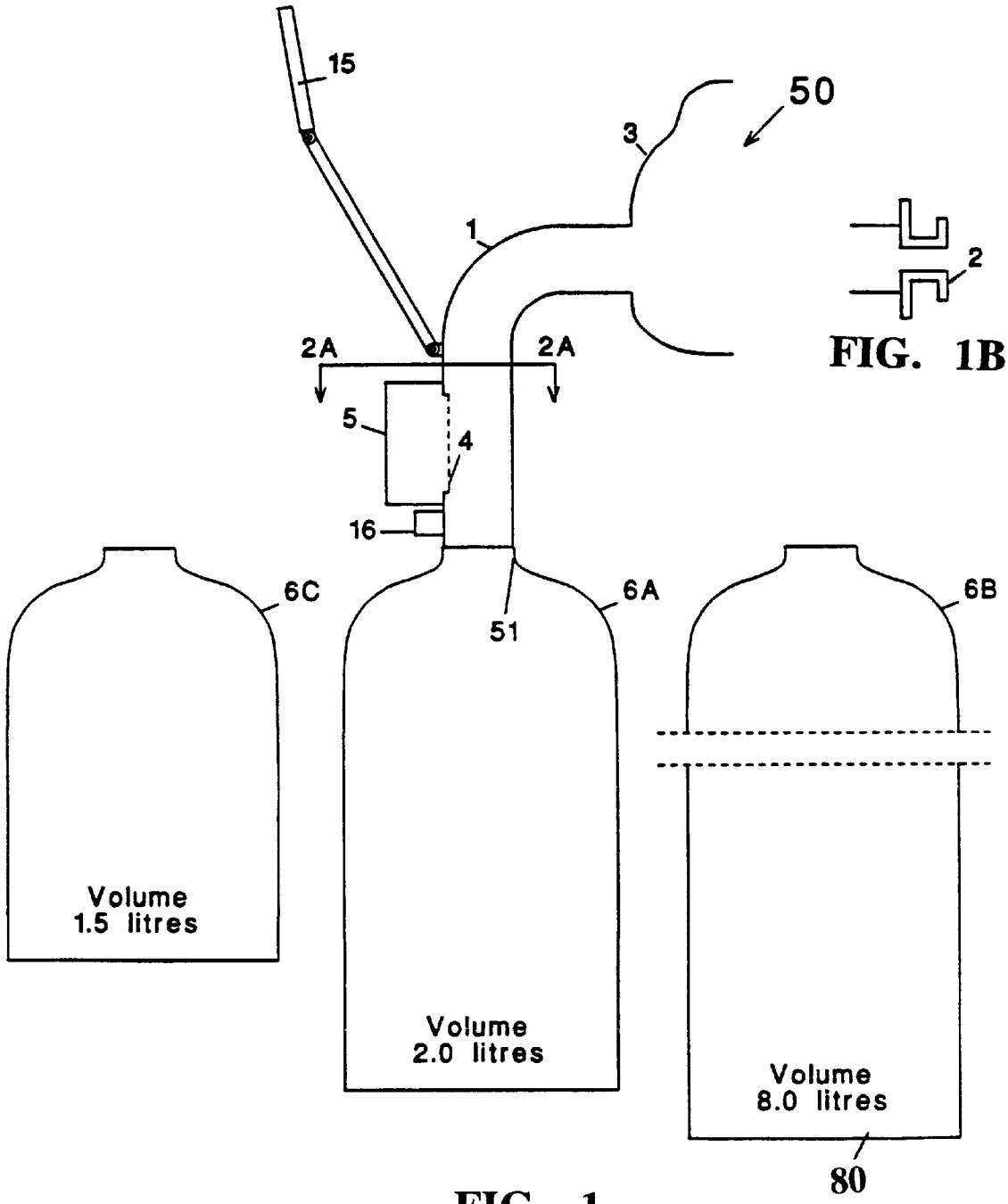
FIG. 1 is a diagrammatic view illustrating apparatus which embodies the present invention.
FIG. 1B is a diagrammatic view illustrating a mouth piece for use alternatively to the oro-nasal mask illustrated for the apparatus in FIG. 1.

Referring to FIG. 1, there is illustrated generally at 50 apparatus for exercising or training a person's respiratory system by the exerciser voluntarily performing a lung ventilation that considerably exceeds the metabolic demands, i.e., a ventilation that is both deeper and more rapid than normal resting ventilation. The apparatus utilizes partial rebreathing of expired gas (air) from a bag, illustrated at 6A, in order to avoid hypocapnia due to hyperventilation.

The apparatus 50 includes an L-shaped or other suitable tube 1 one end of which is suitably fitted with an oro-nasal mask 3 for communicating a flow of air between the tube 1 and the person's respiratory system. Alternatively, the tube may be fitted with a mouth piece, illustrated at 2 in FIG. 1B, or other suitable device for flowing air between the tube 1 and the person's respiratory system.

The other end of the tube 1 is connected to the bag 6A, which is suitably made of flexible gas-tight material such as plastic film so that it is inflatable and deflatable. Air may thus be inspired from the bag 6A or expired thereto along the flow path provided by tube 1. The thickness and other properties of the bag material as well as the tube diameter are chosen in accordance with principles commonly known to those of ordinary skill in the art to which this invention pertains so as to minimize breathing resistance, i.e., so that the pressure required to rapidly inflate and deflate the bag 6A is minimal. Thus, it is considered desirable that this pressure not exceed about plus and minus 2 cm. water for inflation and deflation respectively of the bag. The mouth 51 of the bag 6A may be sized to be stretched over the end of tube 1 or alternatively provided with a fitting or other suitable means for gas-tight attachment to the tube 1.

Figure 2C:
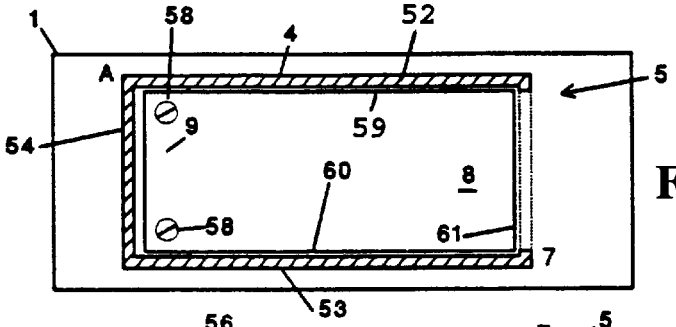
FIG. 2C is a sectional view thereof taken along lines 2C—2C of FIG. 2B.
Figure 2B:
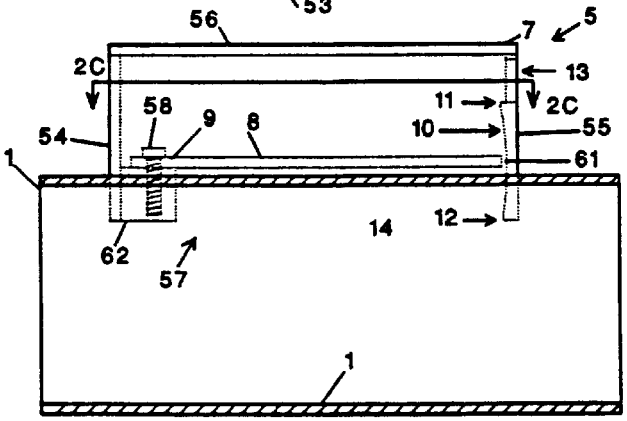
FIG. 2B is a partially sectional view thereof taken along lines 2B—2B of FIG. 2A.
Figure 2A:
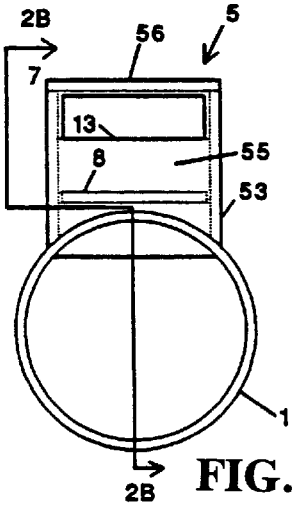
FIG. 2A is a sectional view of the apparatus taken along lines 2A—2A of FIG. 1 without the rebreathing bag therefor being shown.

A valve assembly 5 is suitably gas-tightly fitted in an opening, illustrated at 4, in the tube 1. Referring to FIGS. 2A, 2B, and 2C, the valve assembly 5 includes a housing 7 in which is contained a valve body or element 8 composed of a rectangular sheet of phosphorbronze or other suitable plastic material having the ability to flex. The housing 7 includes a pair of side walls 52 and 53, a pair of end walls 54 and 55, and an upper wall 56. The side and end walls extend through opening 4 and gas-tightly engage the corresponding sides of opening 4. The housing 7 does not include a lower wall thereby leaving an opening, illustrated at 57, for flow of air between the tube 1 and the interior of valve housing 7. The housing 7 includes a member 62 suitably attached to or integral with the lower interior surface of end wall 54 to provide a ledge upon which one end 9 of the valve body 8 is laid and fastened thereto by a pair of screws 58 or by other suitable means such as rivets, glue, or a tongue-in-groove arrangement. The valve body 8 is suitably sized so that its three free edges 59, 60, and 61 are closely adjacent corresponding walls 52, 53, and 55 respectively without touching them. This allows the valve body 8 to freely flex for vertical movement of edge 61 along wall 55 but with minimized leakage of air between the free edges and the corresponding walls. The wall 55 is shaped to have a curved or concave contour, illustrated at 10, for retaining the close fit between free edge 61 and wall 55 as the valve body 8 flexes for movement of free end 61 upwardly and downwardly. An opening, illustrated at 13, is provided in the upper portion of end wall 55, and the contour 10 ends at the opening 13. Thus, the valve 5 is closed when the valve body 8 is positioned with its free edge 61 in closely fitting relationship with contoured surface 10 so as to substantially prevent flow of air to or from the tube 1. Flexing of the valve body 8 so that its free end 61 rises above the contoured surface at 11 or drops below the contoured surface at 12 opens the valve 5 to the flow of air into or out of tube 1 through the interior of housing 7 and through the opening 13.

The sizing and choice of materials for the valve 5 are selected, in accordance with principles commonly known to those of ordinary skill in the art to which this invention pertains, so that the positive or negative gas pressure required to flex the valve body 8 to open the valve 5 will allow full inflation and deflation of the bag 6A on expiration and inspiration respectively before gas (air) flow occurs through the valve 5 out of and into the tube 1. Thus, upon expiration into bag 6A, the pressure within the flow path through tube 1 is insufficient to open the valve 5 until substantially full inflation of the bag 6A has occurred, after which excess expired air is released through the valve 5 when the valve body 8 is flexed for movement of free edge 61 upwardly beyond the contoured surface 10. Upon inspiration, substantially all of the air in bag 6A is inspired with the valve 5 closed, after which the pressure drop caused by continued inspiration causes the valve body to be flexed for movement of the free edge 61 downwardly beyond the contoured surface 10 to open the valve 5 thereby admitting fresh air to the flow path within tube 1. The inflation and deflation pressures of the bag 6A should, at its mouth 51, be desirably no more than plus and minus 2 cm. water respectively.

The present invention is not limited to the type of valve described above. For example, the valve may alternatively be a spring-loaded disc valve. For another example, as discussed hereinafter with reference to FIG. 2D, a two-valve arrangement may be provided wherein one spring-loaded valve 5*a* opens during inspiration and the other spring-loaded valve 5*b* opens during expiration.

Figure 3:
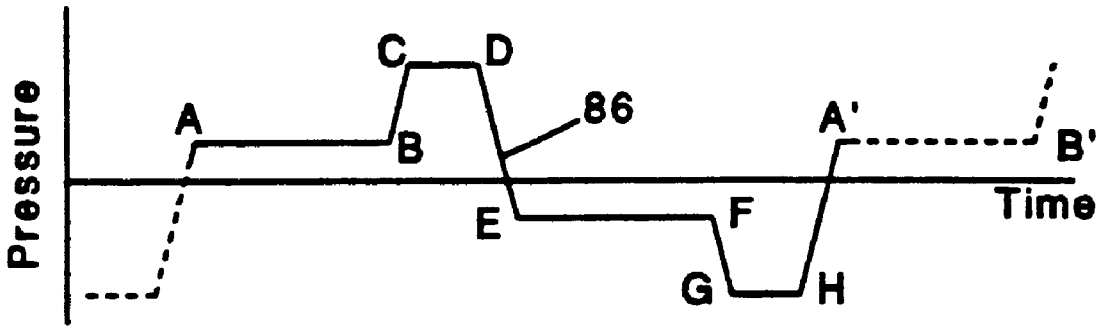
FIG. 3 is a graph of pressure within the air way of the apparatus during a period of inspiration and expiration.
Figure 5:
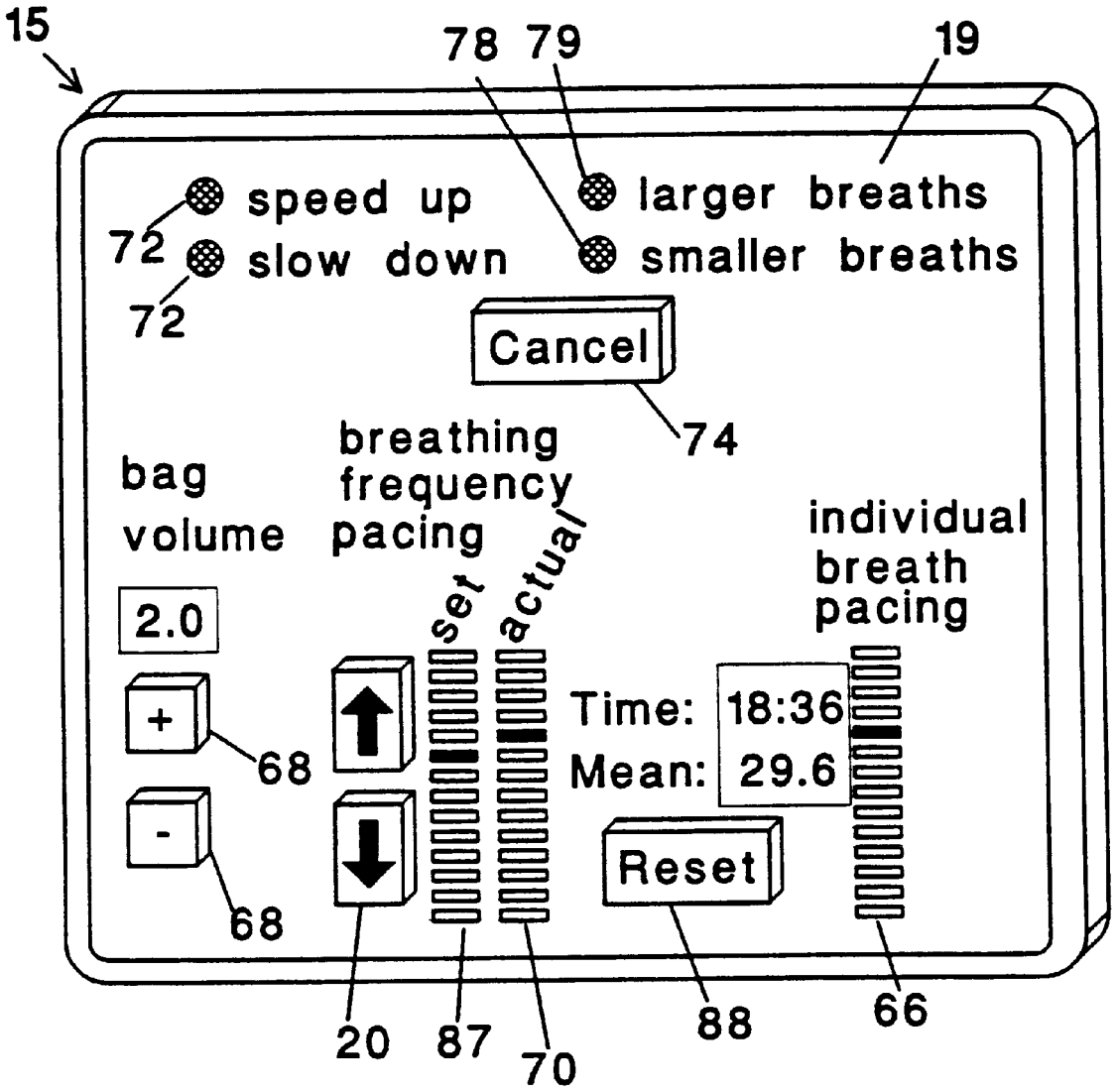
FIG. 5 is a diagram illustrating a computer display therefor.

Referring to FIG. 1, the exercise apparatus 50 includes a sensor, illustrated at 16, suitably connected to the tube 1 to sense changes in the air flow path. The sensor 16 is suitably connected to a computing unit 15, which is shown in FIG. 1 to be suitably mounted to the tube 1 so that its screen, illustrated at 19 in FIG. 5, is viewable by the exerciser, to determine the exerciser's breathing frequency. The sensor 16 may suitably be of a type to sense pressure, temperature, or flow rate changes within the tube 1 or changes in gas composition or humidity or other conditions within the tube. Sensor 16 may, for example, be a pressure transducer placed in the wall of the breathing tube 1 adjacent to bag 6A. Transducer 16 generates a signal which is graphically depicted at 86 in FIG. 3. Section AB of this graph represents the expiration filling bag 6A. When the bag is full, the pressure rises slightly (BC) as valve 5 is deflected and opens. Section CD represents the time that valve 5 stays open. Section DE represents the closing of valve 5 and the beginning of the inhalation of the gas from bag 6A, which lasts during section EF. Section FG represents opening of the valve and the beginning of inhalation of fresh air. Section GH represents the duration of the inhalation. Section HA' represents closing of the valve and the beginning of the next expiration into the bag.

The monitoring of the alveolar ventilation depends on determining the gas flow as the predetermined or known volume of gas (air) in the fully inflated bag 6A is inhaled and by measurement of the duration (AB) of this inspiration. By also recording the time (BD) that the fresh air is inhaled, the volume of fresh air in the breath ($V_{FA}$) can be adequately calculated based on the assumption that gas flow remains essentially constant during the inhalation. This is considered to be an acceptable assumption given the high ventilation rates used for RMT. The fresh air volume supplies the dead space in the apparatus ($V_{D,A}$), the dead space of the lungs and airways ($V_{D,L}$), and the portion of the breath that reaches the alveoli ($V_A$). Thus, $$V_{FA}=V_{D,A}+V_{D,L}+V_A,$$

where $V_{D,A}$ is fixed by the design of the apparatus and $V_{D,L}$ is known from standard texts in respiratory physiology. By multiplying $V_A$ by the average measured breathing frequency, a representative value for the alveolar ventilation ($V'_A$) is obtained. This $V'_A$ is averaged over a suitable number of breaths.

The known volume of bag 6A divided by the duration of section EF (FIG. 3) yields the average gas flow rate of inspiration. It is reasonable to assume that, with the high levels of ventilation used for RMT, the inspiratory flow rate is essentially constant. Hence, this calculated average gas flow rate multiplied by the time interval GH will yield the volume of fresh air inhaled in the breath ($V_{FA}$). By subtracting the predetermined values for $V_{D,L}$ and $V_{D,A}$, the $V_A$ of this breath is obtained. The average $V'_A$ is calculated by summing the $V_A$ for a suitable number of breaths, for example, ten, and dividing this sum by the summed durations of these breaths. This $V'_A$ is then compared with the programmed target ventilation. If the $V'_A$ deviates more than, for example, 20%, the display unit 15 has a signal, illustrated at 79 in FIG. 5, to notify the exerciser to take deeper breaths in case he/she has undershot the target and a signal 78 to notify the exerciser to take more shallow breaths if the target has been overshot. The warning signals 78 and 79 may have different acoustic and/or optical characteristics. For example, such alarms may be embodied as light emitting diodes, as shown, or buzzers or both. It can be seen that, alternatively, expiratory phase recordings of gas flow may be used for determining $V'_A$ since the inspiratory and expiratory flows may be considered to be essentially equal for these purposes. The opening and closing of valve (5) may alternatively be recorded, for example, by signals from strain gauges attached to the valve body 8, optically by photocells in the valve housing 7, by a meter sensing the flow in tube 1 or through the valve 5, or by other suitable means.

Figure 2D:
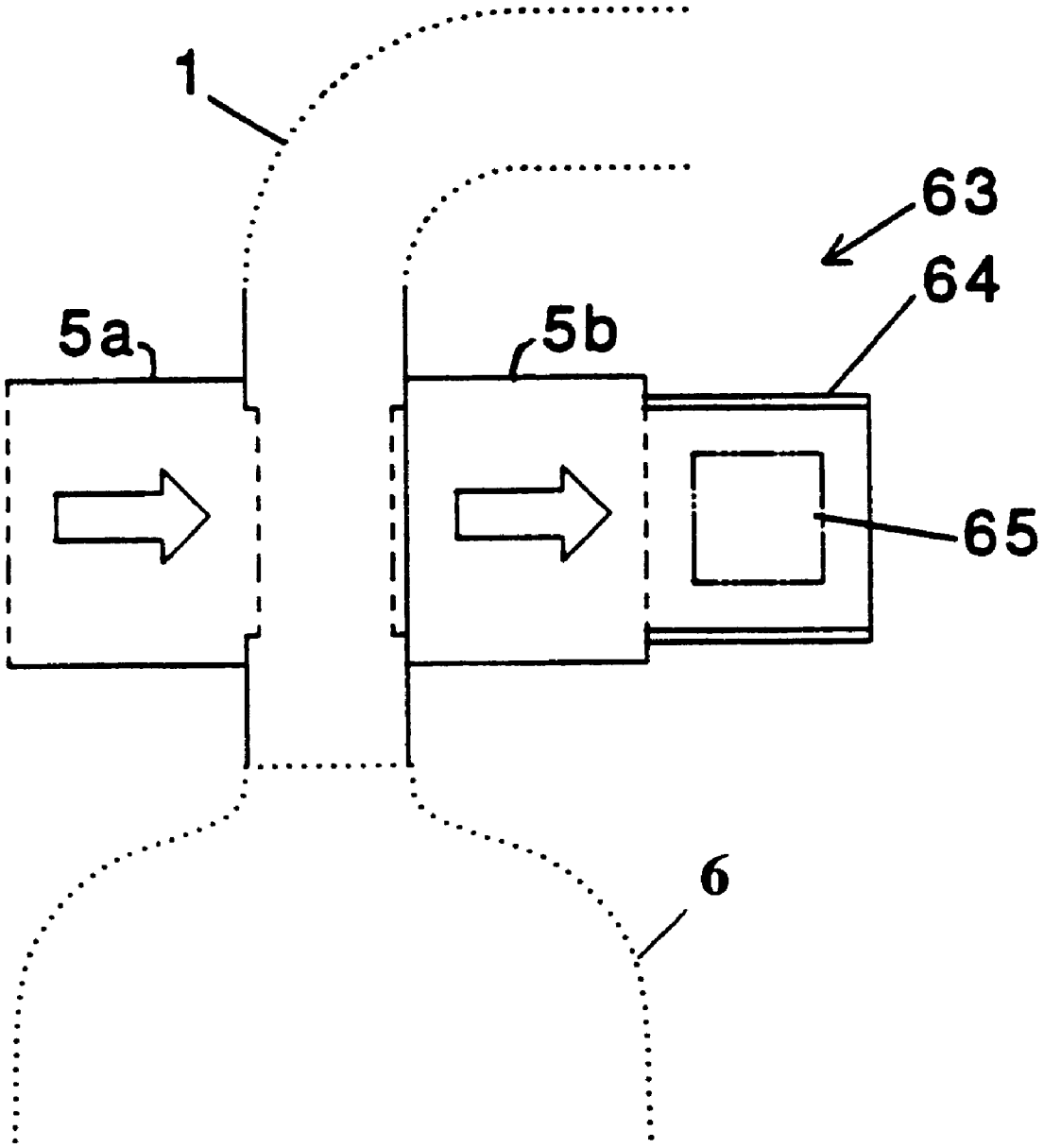
FIG. 2D is a partial view similar to that of FIG. 1 illustrating an alternative embodiment of the present invention.

Referring to FIG. 2D, there is illustrated at 63 an alternative embodiment of the exercise apparatus wherein two valves 5*a* and 5*b* are connected to the tube 1. Valve 5*a* is provided to open during inspiration after the bag 6A is substantially fully deflated to draw fresh air into the air flow path way in the tube 1. Valve 5*b* is provided to open during expiration after the bag 6A is substantially fully inflated to release excess expired air. Otherwise, the valves 5*a* and 5*b* are closed.

A short piece of tubing or hose 64 is suitably attached to the exhaust side of valve 5*b* and has a suitable volume of, for example, 20 ml. to serve as a reservoir of expired gas. A meter or sensor, illustrated at 65, which is described hereinafter, is placed within the hose 64. Overventilation will manifest itself by an abnormally high oxygen concentration and, by necessity, an abnormally low carbon dioxide concentration in the expired gas, and underventilation will lead to the opposite condition. Thus, overventilation or underventilation may be determined by measuring oxygen concentration in the expired gas. Accordingly, if desired, the meter 65 is selected to be an oxygen sensor, which is suitably placed within the tubing 64 to measure and record oxygen partial pressure in the reservoir of expired gas. The oxygen sensor may, for example, be a fuel cell or a paramagnetic oxygen sensor. The expired gas reservoir allows the oxygen meter 65, which may be relatively slowly acting, to analyze the expired gas during the expiration phase of a breath and during the inspiration phase of the following breath. The oxygen meter 65 is desirably positioned inside the hose 64 as close to the expiration valve 5*b* as possible to thus measure the oxygen in the alveolar portion of the expired gas. The output from the oxygen meter 65 is fed to the computing unit 15 which is suitably programmed to compare the output with predetermined minimally and maximally acceptable limits. Such limits can be set at, for example, a low oxygen pressure of 90 mm of mercury and a high value of 110 mm of mercury. The corresponding carbon dioxide pressures will, assuming a reasonably normal respiratory quotient, not expose the exerciser to dangerous or unduly unpleasant hyper- or hypocapnia. Moreover, the minimally acceptable oxygen limit ensures that the exerciser will not be exposed to undue hypoxia. An alarm (not shown) may be provided to give a warning in the event of deviations from these predetermined limits, thus alerting the exerciser to the need for an altered breathing pattern.

Alternatively, meter 65 may be selected to be a carbon dioxide meter (or a sampling port for a carbon dioxide meter may be placed in the short piece of tubing or hose 64) to thus measure the carbon dioxide partial pressure in the alveolar portion of the expired gas and thereby assure proper alveolar ventilation. The output from the carbon dioxide meter is fed to the computing unit 15 which compares the output with predetermined minimally and maximally acceptable limits. Such limits would be chosen so as to prevent undue hyper- or hypocapnia. They can be set at, for example, a low carbon dioxide pressure of 30 mm of mercury and a high value of 50 mm of mercury. The corresponding oxygen pressures will, assuming a reasonably normal respiratory quotient, not expose the trainee to dangerous or unduly unpleasant hypoxia. An alarm and/or light (not shown) may be provided to provide warning in the event of deviations from these predetermined limits thus alerting the exerciser to the need for an altered breathing pattern. It shall be understood that an oxygen or carbon dioxide sensor, while it may be desirable, is not required for practice of the present invention.

Figure 4:
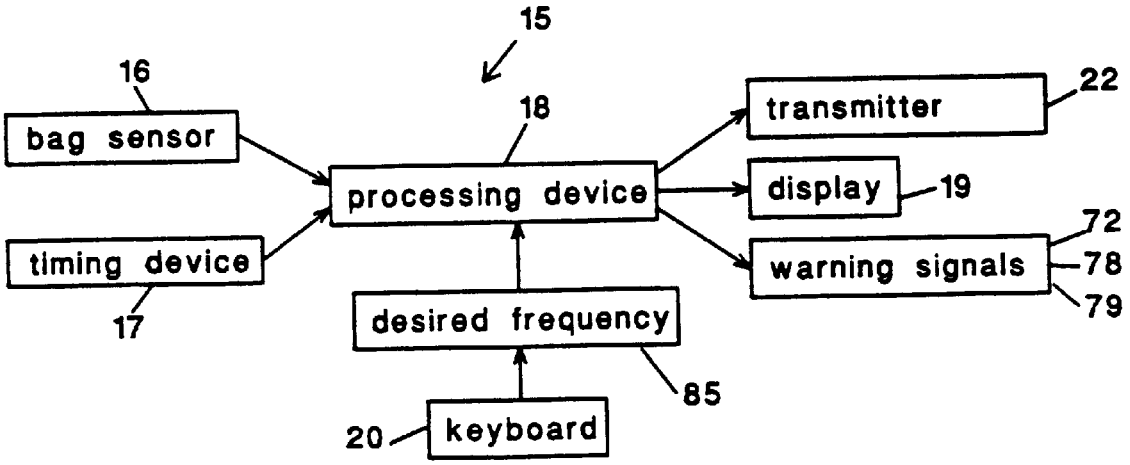
FIG. 4 is a block diagram illustrating monitoring, processing, and pacing for the apparatus.

Referring to FIG. 4, the computing unit 15 includes a timing device 17 for indicating elapsed time. Timing device 17 may, for example, be a crystal controlled oscillator with a known pulse frequency and a counter for the number of pulses between breaths. The number of pulses counted can then be converted to the equivalent breathing frequency (number of breaths per minute) by a processing device 18. The breathing frequency may then be stored in memory of computing unit 15 and displayed. The mean breathing frequency, displayed as illustrated at 89, over, for example, five breaths is calculated from the stored values and displayed at 70 on display 19. Actual frequency display 70 contains increments of mean breathing frequency from, for example, 24 to 40 breaths per minute. The exerciser can select a desired target breathing frequency, as illustrated at 85, e.g., by using a keyboard 20 (which may comprise push buttons on the display 19), which is then shown in display 19. Thus, the exerciser is paced for the desired frequency, as set at 87, by the display at 70 of the actual frequency, i.e., the actual frequency display 70 provides feedback to the exerciser so that he or she may be paced to slow down or speed up his or her breathing so that the actual frequency at 70 matches the set frequency at 87.

An individual breath pacing signal is suitably calculated by processing device 18 based on the set breathing frequency 87 and displayed as illustrated at 66 by a series of light emitting diodes which are successively lighted from bottom to top for the calculated duration of inhalation and from top to bottom for the calculated duration of exhalation. This allows the exerciser to pace each individual breath so as to terminate inspiration and exhalation at the times indicated on display 66. It would also be desirable to display actual stages of each individual breath to provide feedback to the exerciser as to whether he or she is ahead of or behind the set individual breath pace. Time from the start of a training session can also be displayed, as illustrated at 76, and can be reset by pushing a reset button 88.

The means by which the selected target breathing frequency, instantaneous and mean breathing frequencies, pacing signal, and warning signals are presented to the exerciser thus include, but are not limited to, optical and acoustical. Computing unit 15 can thus be programmed to alert the exerciser, as described above, should the exerciser deviate from the selected breathing frequency for a certain number of breaths, for example, five breaths, or for a certain length of time, for example, ten seconds. The computing unit 15 may also be programmed to store and display progress information about the individual exerciser.

Figure 6:
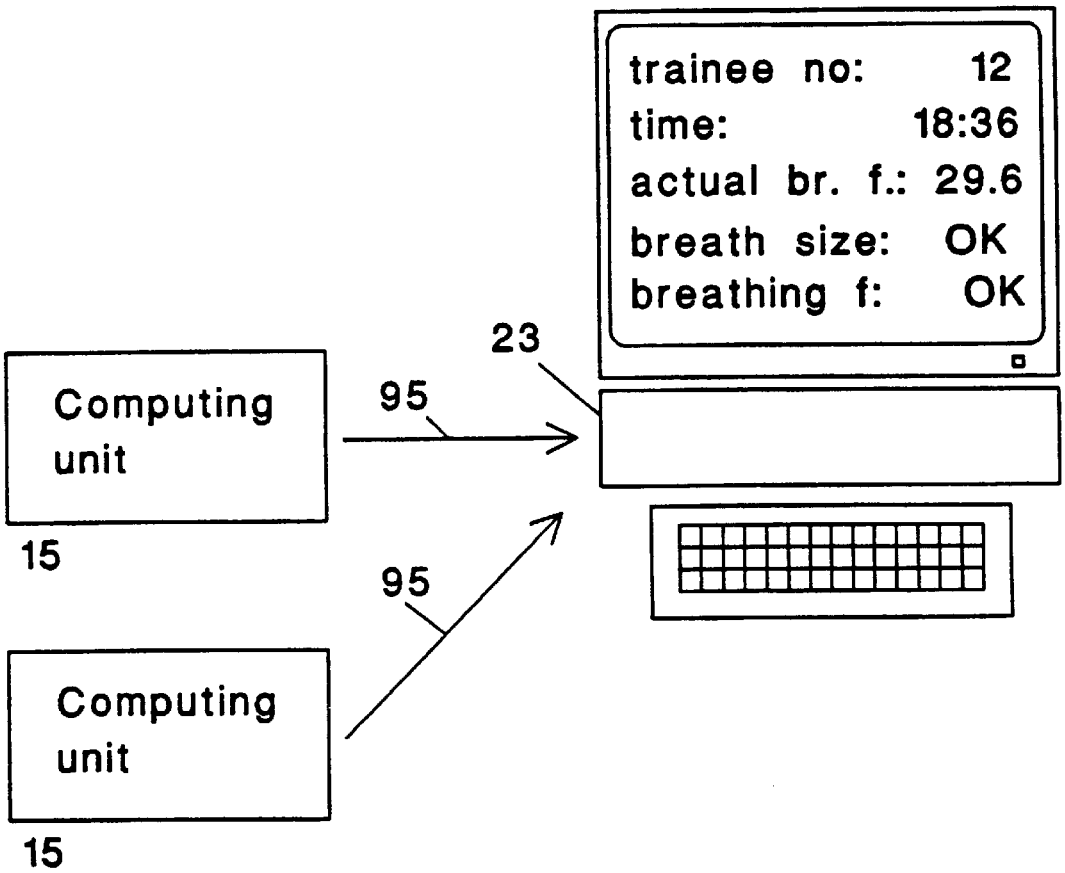
FIG. 6 is a diagram illustrating a computer/monitoring device therefor.

If desired, the information obtained by monitoring the breathing of one or more exercisers by one or more computing units 15 may be transmitted by a transmitter 22, as illustrated at 95 in FIG. 6, to a remote monitoring device 23, such as by wire, radio signal, or light signal (e.g., infrared). The monitoring device 23 also incorporates a computer which processes the signals and displays them so as to allow monitoring of the performance of one or more exercisers. In addition, the remote monitoring device 23 may have alarm functions which alert the trainer to deviations from the training targets selected, as earlier described, on each trainee's computing unit 15. Furthermore, like the computing units 15, the remote monitoring device 23 may have storage functions which allow data retrieval and processing which can be used for monitoring of short and long term training progress. The computing units 15 and monitoring device 23 can be suitably programmed, including prompting of the user, to perform as described herein using principles commonly known to those of ordinary skill in the art to which this invention pertains.

Figure 7:
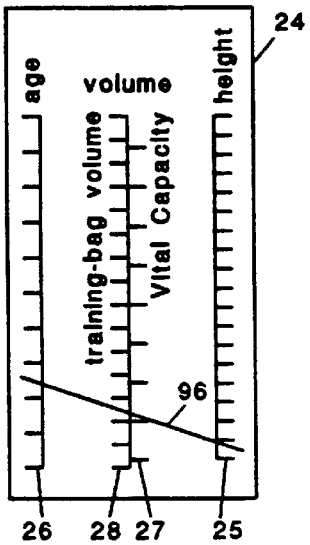
FIG. 7 is a plan view of a card for determining bag volume.

Referring to FIG. 7, there is illustrated at 24 a card for use by an exerciser for determining a suitable bag volume for beginning exercising. The card 24 has printed thereon a vertical scale 25 in centimeters or feet and inches spanning a normal range of body heights and another vertical scale 26 in years spanning a suitable age range representative of the expected user clientele. Between scales 25 and 26 are two essentially vertical scales 27 and 28 for vital capacity and training bag volume respectively, spanning a range of volumes expressed, for example, in liters. By conventional practice, a straight line, illustrated at 96, connecting the exerciser's age and height on scales 26 and 25 respectively will indicate the normal vital capacity on scale 27 at its point of intersection therewith. A suitable bag volume (training volume) to begin exercising is suitably a percentage of the vital capacity. The training volume scale 28 reflects this percentage, which is believed to suitably be about 60%. Thus, the numbers on scale 28 represent 60% of the corresponding vital capacity numbers on scale 27. Since it is known that men and women have somewhat different relationships between antropormetric data and vital capacities, separate scales are desirably provided for males and females.

Alternatively, the information on card 24 may be entered in either of computing devices 15 or 23 or other suitable computer programmed to translate an exerciser's gender, age, and height into a suitable bag volume for beginning exercising.

Over time as the exerciser's respiratory muscle endurance increases, he or she should find that the bag volume which has been used is no longer adequate for effective training and that a larger volume bag is needed. Referring again to FIG.

1, in accordance with the present invention, the exercise apparatus 50 is provided with a plurality of bags 6B and 6C in addition to 6A each of which is inflatable for receiving a different predetermined quantity of expired air. The bags 6A, 6B, and 6C may have their fully inflated volume capacities printed thereon, as illustrated at 80. Thus, when a bag such as bag 6C becomes too small for the exerciser, it may be easily and quickly replaced with the next size larger bag, for example, bag 6A. The set of bags may desirably comprise a series of bags with preselected maximal volumes ranging, for example, from perhaps about 1.5 to 8 liters in perhaps roughly 15% increments.

Figure 8:
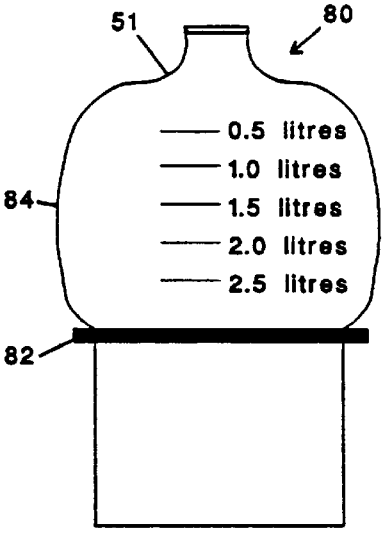
FIGS. 8, 9, and 10 are diagrammatic views illustrating various means for adjusting bag volume.
Figure 9:
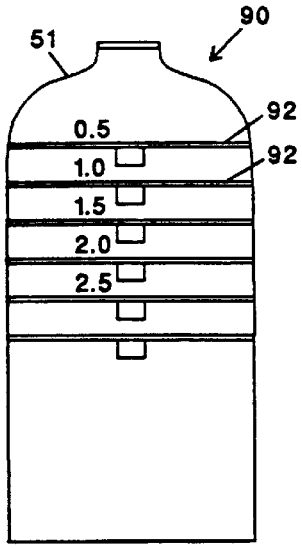
Figure 10:
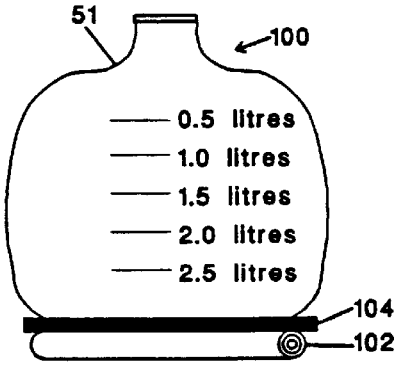

Alternatively, a single bag may be convertible to different maximal volumes. Referring to FIGS. 8, 9, and 10, there are illustrated generally at 80, 90, and 100 respectively bags having such convertibility. Thus, for example, the volume of bag 80 may be adjusted by a clip 82, limiting inflation and deflation to the upper part 84 of the bag. For another example, the volume of bag 90 may be made smaller by pushing stepped plastic "zip-lock" style holders 92 or the like together. For another example, the bottom 102 of the bag 100 may be rolled up and secured by clamp 104 to reduce its volume. Thus, it is apparent that various suitable means may be provided for adjusting volume of a bag.

Figure 11:
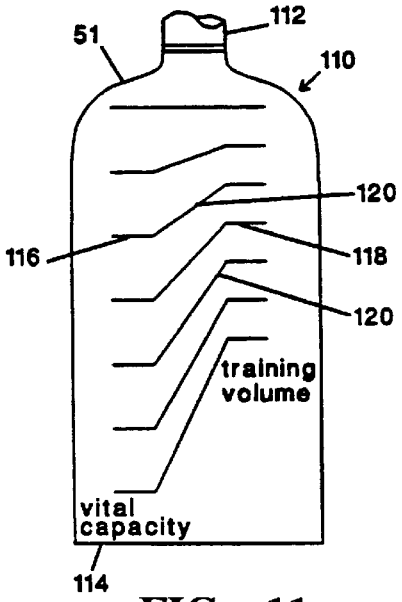
FIG. 11 is a diagrammatic view of an alternative embodiment of a breathing bag.

Referring to FIG. 11, a bag 110, which may be similar to bag 6A, may, if desired, alternatively have a short tube 112 to which it is intended that bag 110 remain attached and which is suitably attachable to tube 1.

Bag 110, when filled with air, is seen to take on the shape generally of a cylinder with a generally constant diameter throughout substantially its height. The bottom end 114 may suitably be sealed by gluing or heating to form a straight seam, and the other end is narrowed to neck 51 to allow a tight fit around one end of tube 112. Although the maximum volume of bag 110 is desirably about 8 liters, it may be less as long as it somewhat exceeds the expected vital capacity of the exerciser. Bag 110 has printed thereon over its height scales 116 and 118 labeled vital capacity and training volume respectively for the purposes of aiding the exerciser to determine the appropriate training volume for him or her, without resort to the card 24 or the need to input age and height information to a computer. The use of the bag 110 also allows the exerciser to more directly and thus more precisely determine training volume without the need to rely on age and height for standard approximations thereof. The vital capacity scale 116 has volume gradations in, for example, liters with, for example, 0.5 liter increments, with lower numbers towards neck 51. The training volume scale 118 is parallel to vital capacity scale 116 and has volume gradations which are 60% (or other suitable percentage) of the vital capacity markings. The vital capacity markings are connected to the corresponding training volume markings by lines, illustrated at 120, printed on the bag 110.

In order to utilize bag 110, the tube 112 should be detached from tube 1, and the bag 110 should be empty. The exerciser should inhale maximally, put the tube 112 in his or her mouth, and exhale as deeply as possible into the bag 110. While holding his or her breath briefly without letting air out of the bag 110, the exerciser should then close off the neck 51 using a suitable means such as, for example, a pressure seal if the bag is so equipped or a clamp. The bag 110 should then be placed on a flat surface and compressed such as by rolling it tightly from its lower end 114 until the remaining or unrolled portion of the bag is well filled, similarly as illustrated for bag 100 in FIG. 10. The exerciser's vital capacity may then be read from scale 116 at the level where the compressed (rolled up) part of the bag ends and its inflated portion begins. The bag 110 may then be emptied, and the training volume selected by following the corresponding diagonal line 120 from the exerciser's vital capacity marking 116, just determined, to the scale 118 where the matching training volume may be read. The bag volume may then be adjusted at this training volume level using means such as illustrated in any of FIGS. 8, 9, and 10, or a bag having the matching training volume may be selected and substituted therefor, in accordance with FIG. 1.

Alternatively, the exerciser can determine his/her vital capacity by attaching empty bags of varying volumes to breathing tube 1. Referring to FIGS. 2A and 2B, opening 13 is then sealed off with a finger, and a full breath is taken in and blown into the bag until no more air can be breathed out. If, when the bag is full, the user can still exhale more, the next larger bag is tried until one is found that the exerciser can just barely fill. The vital capacity corresponds to the volume printed on this bag. If in the first breath the chosen bag cannot be filled, stepwise smaller bags are tried. Once the vital capacity has been determined, the recommended training volume corresponding to that vital capacity can be found by use, as earlier described, of scales 27 and 28 on volume card 24 or by calculating 60% of the vital capacity. The bag with a volume closest to that training volume is then connected to tube 1 and used for the RMT.

Referring to FIG. 5, to begin exercising, buttons 20 are pushed to set the desired pacing frequency of breaths per minute on scale 87, and the training-bag volume is also entered on computing unit 15 as illustrated at 68. The exerciser then puts mouth piece 2 in the mouth and preferably dons a nose clip to prevent undue air flow through the nose. Alternatively, the oro-nasal mask 3 is used in which case no nose clip is needed. The exerciser then attempts to breathe at the frequency indicated by the individual breath pacing display 66 on computing unit 15. If the exerciser's displayed actual breathing frequency at 70, which is the moving average of, for example, 5 breaths, does not match that set on the set frequency display 87, the exerciser should notice and adjust his or her respiration rate up or down as needed to match the desired frequency 87. If the breathing frequency of the exerciser deviates for more than, for example, 5 seconds by more than, for example, 3 breaths per minute from the preset rate 87, the appropriate (speed up or slow down) optical warning light 72 is lit and/or an acoustic signal will sound until a cancel button 74 is pushed or until the breathing frequency is corrected.

Each expiration will fill bag 6A with alveolar air which has a higher carbon dioxide content and lower oxygen content than fresh air. Once bag 6A is full, the air pressure in tube 1 will rise slightly so as to exceed the opening pressure of valve 5 which will cause valve 5 to open to expel the remainder of the expired air. The first part of the following inspiration will consist of the carbon dioxide-rich gas from the preceding expiration which was stored in bag 6A, and, when bag 6A is emptied, the air pressure in tube 1 will fall so as to open the valve 5 and allow fresh air to be inhaled therethrough. The depth of the inspiration should normally be adjusted by the physiologic control mechanisms of the body which serve to ensure an adequate carbon dioxide and oxygen exchange. The deep and rapid breathing induced by the device should ensure the desired RMT, and this exercise may be continued for, for example, 30 minutes per training session as guided by timing device 17 in the computing unit 15 and displayed as illustrated at 76.

In accordance with the findings discussed in the previously discussed Boutellier and Piwko and Boutellier et al articles, the breathing frequency should initially be selected at between 40 and 50 breaths per minute. In subsequent training sessions, the preselected breathing frequency and/or the preselected rebreathing volume are increased in small increments so as to push the exerciser's lung ventilation to ever increasing levels that are just barely sustainable for 30 minutes. These adjustments may be modified by trial and error. Thus, if the exerciser becomes exhausted by a certain combination before the 30 minute training session is finished, the frequency and/or training bag volume is reduced stepwise until sustainable for a full 30 min. It is believed that, ideally, the 30 minute training sessions should be performed once daily, 5 days a week, and for 4 weeks in order to obtain a good enhancement of submaximal exercise endurance as demonstrated by the previously discussed Boutellier and Piwko and the Boutellier et al articles. It is of course understood that future research may result in further optimization of the training schedules described above.

It is known from the physiological literature that occasionally even healthy persons may hyper- or hypoventilate, i.e. breathe more or less than is called for by the metabolism. Such deviations from normal breathing patterns may be due to, for example, nervousness in the case of hyperventilation or an automatic reduction of the breathing whenever the subject breathes on a breathing apparatus (so called $CO_2$ retainers). Such deviations may cause unpleasant sensations such as dizziness, headaches, or, in the case of hypoventilation, even dangerous hypoxia. Should the exerciser experience hyperventilation and thus hypocapnia by taking breaths that are too deep for a given breathing frequency, the flow throughout the inhalation will be excessive and thus the calculated $V'_A$ too high. This should trigger the volume warning light, illustrated at 78, and/or any other alarm and prompt the exerciser to take smaller breaths. Conversely, if the exerciser hypoventilates, the inspired gas flow will be too low and the volume warning light, illustrated at 79, and/or alarm should go off and prompt the exerciser to take deeper breaths.

The exercise apparatus of the present invention thus allows the user to determine his/her vital capacity and, based on that determination, select and set, without calculations, the desired rebreathing volume. Furthermore, the exercise apparatus allows easy change of the rebreathing volume as may be called for by changes in the training protocol, i.e., as the respiratory system endurance improves. The exercise apparatus also allows the user to select the desired breathing frequency and enter it into pacing means for feedback so that the user may be aided in achieving the desired breathing frequency. Preferably, the pacing means is programmed to record the breathing frequency actually performed and presents it optically in the same format as the desired frequency is entered, as seen at 87 and 70 in FIG. 5, so as to allow the user to easily compare the two and make necessary adjustments of his/her breathing frequency. Moreover, in case of significant deviations from the desired frequency, such as due to inattentiveness or exhaustion on part of the trainee, an optical and/or acoustic signaling device in the electronic monitor is desirably provided to alert the trainee and/or trainer, if present, to the situation. Alternatively, the signal is transmitted by wire or wireless means to a central receiver which can conveniently be monitored by a trainer, and the signal from each trainee may be coded so as to allow the trainer to identify the trainee. In order to reduce the risk of dangerous or unpleasant hypoxia, hypercapnia, or hypocapnia, it should be ensured that the supply of fresh air to the alveolar space in the lung (alveolar ventilation) is adequate to sustain, with a safety margin, an oxygen consumption and carbon dioxide production (metabolism) corresponding to the needs of the body at rest. Deviations from this alveolar ventilation will trigger a light 78 or 79 or an alarm alerting the user to the need for an altered breathing pattern.

It should be understood that, while the invention has been described in detail herein, the invention can be embodied otherwise without departing from the principles thereof, and such other embodiments are meant to come within the scope of the present invention as defined by the appended claims.

What is claimed is:

1. Respiratory system exercise apparatus comprising a bag which is inflatable for receiving a predetermined volume of expired air, means for flowing air between said bag and the respiratory system for expiring air into said bag and for rebreathing thereof, a valve adapted to be closed to thereby provide a first resistance to passage of air through the valve during rebreathing of expired air in said bag and adapted to open to thereby provide a second resistance to passage of air through the valve in response to deflation of said bag to thereby admit fresh air to said flow means, the first resistance being higher than the second resistance.

2. Apparatus according to claim 1 further comprising means for varying the predetermined volume of said bag.

3. Apparatus according to claim 2 further comprising means for converting gender, height, and age of a person to a predetermined bag volume which is a predetermined percentage of normal vital capacity for a person of said gender, height, and age.

4. Apparatus according to claim 3 wherein said converting means comprises a card individualized for gender and having height and age scales and further having a bag volume scale providing the predetermined bag volume at the intersection therewith of a straight line connecting the person's height and age.

5. Apparatus according to claim 3 wherein said converting means comprises a bag having a pair of scales of vital capacity and corresponding predetermined bag volume respectively.

6. Apparatus according to claim 1 further comprising means for deriving total volume of rebreathed and fresh air inspired during a breath.

7. Apparatus according to claim 1 wherein said valve is further adapted to open to thereby provide the second resistance to passage of air through the valve in response to said bag being fully inflated to release excess expired air through the valve.

8. Apparatus according to claim 7 further comprising means for measuring oxygen partial pressure in the excess expired air released through said valve.

9. Apparatus according to claim 7 further comprising means for measuring carbon dioxide partial pressure in the excess expired air released through said valve.

10. Apparatus according to claim 1 further comprising a pressure sensor for sensing pressure changes in the air flow means from which the volume of inspired fresh air during a breath may be determined.

11. Apparatus according to claim 1 further comprising means for recording performance of the exerciser on the apparatus.

12. Apparatus according to claim 1 further comprising a means for pacing breathing frequency.

13. Apparatus according to claim 12 wherein said pacing means includes means for pacing duration of an individual breath.

14. Apparatus according to claim 12 further comprising means for signalling non-compliance with the means for pacing breathing frequency.

15. Respiratory system exercise apparatus comprising a plurality of bags each of which is inflatable for receiving a different predetermined quantity of expired air, means for flowing air between a selected one of said bags and the respiratory system for expiring air into said selected bag and for rebreathing thereof, and a valve adapted to be closed to thereby provide a first resistance to passage of air through the valve during rebreathing of expired air in said selected bag and adapted to open to thereby provide a second resistance to passage of air through the valve in response to deflation of said selected bag to thereby admit fresh air to said flow means, the first resistance being higher than the second resistance.

16. Apparatus according to claim 15 further comprising means for pacing breathing frequency.

17. Apparatus according to claim 16 further comprising means for signalling non-compliance with the pacing means breathing frequency.

18. Apparatus according to claim 15 further comprising means for deriving total volume of rebreathed and fresh air inspired during a breath.

19. Apparatus according to claim 15 further comprising means for converting gender, height, and age of a person to a predetermined bag volume which is a predetermined percentage of normal vital capacity for a person of said gender, height, and age.

20. Apparatus according to claim 19 wherein said converting means comprises a card individualized for gender and having height and age scales and further having a bag volume scale providing the predetermined bag volume at the intersection therewith of a straight line connecting the person's height and age.

21. Apparatus according to claim 15 wherein said valve is further adapted to open to thereby provide the second resistance to passage of air through the valve in response to said bag being fully inflated to release excess expired air through the valve.

22. A method for exercising the respiratory system comprising selecting a bag which is inflatable for receiving a predetermined volume of expired air, coupling the bag to the respiratory system to provide a flow path for flowing air therebetween, providing a valve adapted to be closed to thereby provide a first resistance to passage of air through the valve during rebreathing of expired air in the bag and adapted to open to thereby provide a second resistance to passage of air through the valve in response to deflation of the bag to thereby admit fresh air to the flow path, the first resistance being higher than the second resistance, and alternately and at a predetermined pace expiring air to fully inflate the bag and inspiring substantially all of the air expired into the bag thereby opening the valve to thereby provide the second resistance to passage of air through the valve to also admit fresh air to the flow path.

23. A method according to claim 22 comprising converting gender, height, and age of the person exercising to a predetermined bag volume which is a predetermined percentage of normal vital capacity for a person of said gender, height, and age.

24. A method according to claim 23 wherein the step of converting comprises selecting the predetermined bag volume from a bag volume scale on a card individualized for gender and having height and age scales wherein the bag volume scale provides the predetermined bag volume at the intersection therewith of a straight line connecting the person's height and age.

25. A method according to claim 22 further comprising incrementally increasing the bag volume as endurance of the respiratory system is increased.

26. A method according to claim 25 wherein the step of increasing bag volume comprises substituting for the bag a bag which is sized for receiving an increased volume of expired air.

27. A method according to claim 22, wherein the valve is further adapted to open to thereby provide the second resistance to passage of air through the valve in response to the bag being fully inflated to release through the valve air expired after the bag is fully inflated, and wherein the method further includes continuing to expire air after the bag is fully inflated to cause the valve to open to thereby provide the second resistance to passage of air through the valve in order to release air expired after the bag is fully inflated.

* * * * *